US005232402A

United States Patent [19]

Lorenzon

[11] Patent Number: 5,232,402

[45] Date of Patent: Aug. 3, 1993

[54] INTERIOR VENTILATION ADJUSTMENT DEVICE

[75] Inventor: Loris Lorenzon, San Biagio Di Callalta, Italy

[73] Assignee: Permasteelisa S.p.A., San Vendemiano, Italy

[21] Appl. No.: 820,818

[22] Filed: Jan. 15, 1992

[51] Int. Cl.[5] ..... F24F 13/18

[52] U.S. Cl. ..... 454/222; 454/273; 454/333

[58] Field of Search ..... 454/196, 214, 222, 273, 454/333, 240

[56] References Cited

U.S. PATENT DOCUMENTS

| | | | |
|---|---|---|---|
| 327,414 | 9/1885 | Scharnweber | 454/196 |
| 633,455 | 9/1899 | Hood | 454/290 |
| 1,204,321 | 11/1916 | Shipp | 454/273 |
| 1,445,067 | 2/1923 | Brooks | 454/196 |
| 1,643,554 | 9/1927 | Glass | 454/222 |
| 1,913,974 | 6/1933 | Clay | 454/333 |
| 2,966,169 | 12/1960 | Reece | 454/333 X |

FOREIGN PATENT DOCUMENTS

| | | |
|---|---|---|
| 1264017 | 3/1968 | Fed. Rep. of Germany . |
| 2410170 | 9/1975 | Fed. Rep. of Germany . |

*Primary Examiner*—Harold Joyce

*Attorney, Agent, or Firm*—Guido Modiano; Albert Josif

[57] ABSTRACT

Interior ventilation adjustment device including a first seat which is arrangeable in a building partition and which is provided with a first opening communicating with the building exterior and a second opening communicating with the building interior. The device further includes a pivoting shutter element for closing said second opening actuated by a lever accommodated in a box-like structure which exclusively opens to the building interior. The shutter element is accommodated in the first seat so as to be out of sight from the building exterior.

19 Claims, 2 Drawing Sheets

INTERIOR VENTILATION ADJUSTMENT DEVICE

BACKGROUND OF THE INVENTION

The present invention relates to an interior ventilation adjustment device.

In known buildings, ventilation between the interior and the outside thereof currently occurs by using windows or, in the case of buildings having continuous structural faces, and therefore a system which is external to the supporting structure of the building and has no vertical discontinuities, by using air conditioning systems.

If windows are used, it is necessary to provide appropriate supporting frames with which adapted hinges must be associated for opening the window, which must have devices suitable for allowing its temporary closure.

All this affects the overall construction costs of the building and furthermore entails other problems such as the maintenance of the closure devices and of the hinges, which must be lubricated in the course of time.

Furthermore, the use of windows entails other problems related to the possibility that they be closed violently in the presence of wind, with consequent possible damage to the glass pane or to the frame.

Instead, in the case of buildings of the type with continuous structural faces, no direct exchange of air between the interior environment and the outside environment is possible.

SUMMARY OF THE INVENTION

The aim of the present invention is therefore to eliminate the problems described above in known types by providing a device which allows to achieve ventilation between the interior and the outside of buildings even of the type with continuous structural faces.

Within the scope of the above aim, an important object is to provide a device which ensures perfect tightness with respect to air and weather and is at the same time structurally very simple.

Another important object is to provide a device which associates with the preceding characteristics that of not requiring particular maintenance and of being at the same time reliable and safe in use.

Still another important object is to provide a device which can be easily and rapidly applied at an adapted region of the building so that its application does not substantially alter the overall aesthetic appearance thereof.

Yet another important object is to provide a device which associates with the preceding characteristics that of allowing a gradual adjustment of the exchange of air between the interior and the outside or vice versa.

Not least object is to provide a device which associates with the preceding characteristics that of having modest costs and can be installed even by personnel which is not particularly trained.

This aim, these objects and others which will become apparent hereinafter are achieved by an interior ventilation adjustment device, characterized in that it is accommodated out of sight within an adapted seat which is connected, possibly through at least one grille and/or filter, to the inside and to the outside of said enclosed space, said device being constituted by at least one shutter which can be sealingly closed on said at least one grille by means of one or more cams which are actuated by at least one lever, said lever being accommodated in a seat which is connected only to the inside of said enclosed space.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
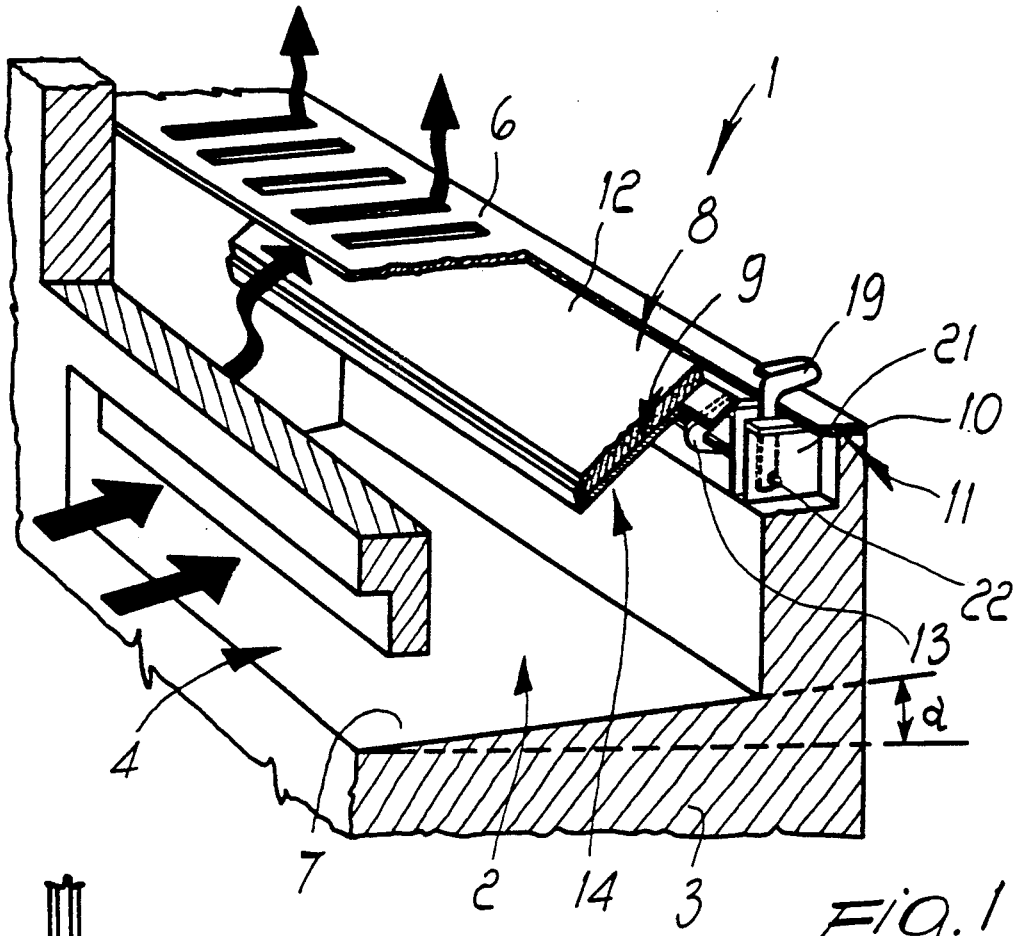
FIG. 1 is a partially sectional perspective view of the device according to the present invention.
Figure 2:
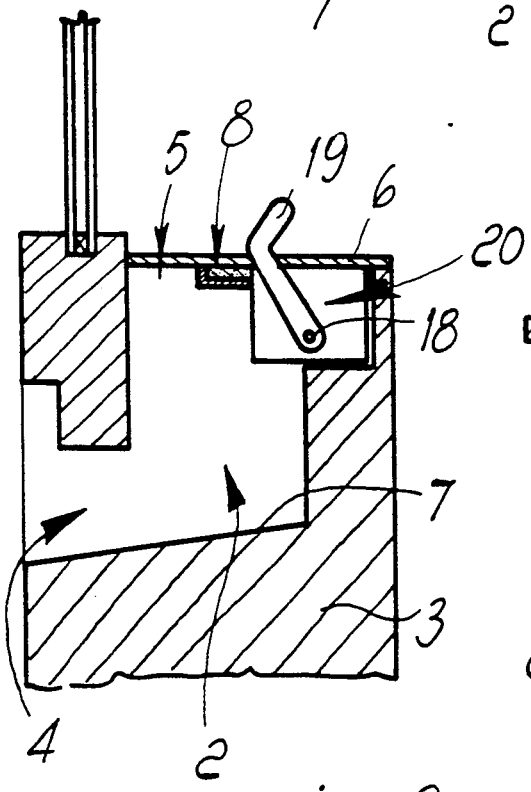
FIG. 2 is a view taken along a sectional plane which is transverse with respect to the shutter.
Figure 3:
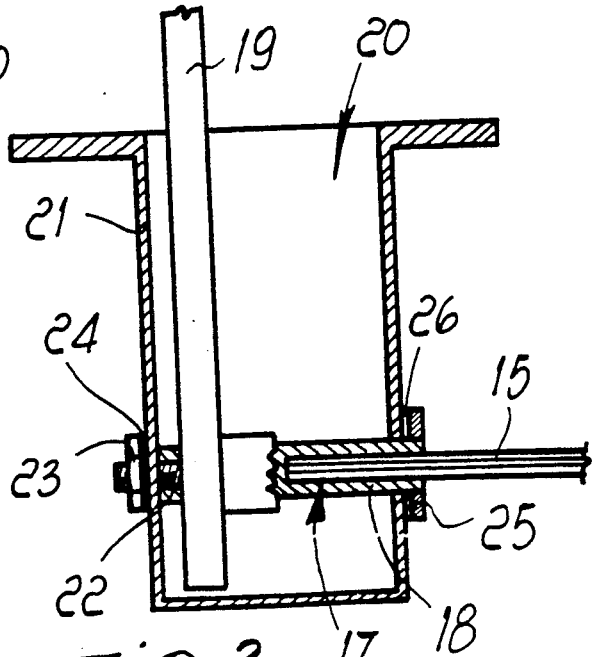
FIG. 3 is a partially sectional view of the arrangement of the lever within the seat which is connected only to the inside of the enclosed space.

With reference to the above figures, the interior ventilation adjustment device, generally designated by the reference numeral 1, is accommodated out of sight within an adapted first seat, designated by the numeral 2, which is defined at the outer perimetric wall 3 of the building or proximate to the interspace between the insulating panel and the glazed face of a continuous-face building.

Said first seat 2 furthermore has a first opening 4 which is connected to the outside environment of the building and a second opening 5 which is connected to the inside of the building.

The first opening 4 may have an essentially rectangular configuration, is preferably defined along an axis which is horizontal with respect to the building and is even only a few centimeters wide.

The second opening 5 is advantageously defined above the first seat 2, which is thus essentially L-shaped.

Conveniently, the second opening 5 can be partially closed by means of at least one adapted and appropriately perforated grille 6.

In order to prevent the access of insects or dust into the first seat 2, it is possible to provide, both at the first opening 4 and at the second opening 5, other possibly removable grilles and/or filters.

The bottom 7 of the first seat 2, which is opposite to the second opening 5, is furthermore inclined at an angle $\alpha$ with respect to the horizontal plane; this inclination allows the outward drainage of any water which has entered through the first opening 4.

The device is furthermore constituted by at least one shutter 8 which is in turn composed of a plate 9 whose shape is approximately equal to that of said grille 6; said plate is arranged in a region underlying said grille and is pivoted, at one end, to a support 10 which is in turn rigidly associated at a perimetric edge 11 of the second opening 5.

Advantageously, said perimetric edge 11 is arranged on the opposite side with respect to the first opening 4 so as to allow the shutter 8 to tilt toward the bottom 7 starting from a position which is adjacent to the grille 6 down to a position which is adjacent to the wall of the seat 2 which is opposite to the first opening 4.

In order to allow optimum airtightness between the environment inside the building and the outside of said building, a first gasket 12 is protrudingly associated at the plate 9 and is thus suitable for sealingly closing the openings provided on the grille 6.

The shutter 8 can be sealingly secured on the grille 6 by means of one or more mutually identical cams 13 which are arranged along a plane which is perpendicular to the plane of the plate 9 and rest at the lower surface 14 of said plate which is directed toward the bottom 7.

Said one or more cams 13 are advantageously mutually equidistant and transversely keyed at a same shaft 15 which has a polygonal transverse cross-section.

Said shaft is freely pivoted at a first shoulder 16 at one end and is inserted, at its other end, at a complementarily shaped second seat 17 which is defined axially with respect to a bush 18 which is in turn rigidly associated with, and protrudes perpendicularly from, the end of a lever 19 which is accommodated within an adapted third seat 20.

Said third seat is obtained by means of a box-like structure 21 which is connected only to the environment inside the building.

A threaded pivot 22 protrudes axially with respect to the bush 18 on the opposite side with respect to the lever 19, and in turn passes at an adapted hole defined laterally to the box-like structure 21, and is rotatably associated thereat by means of a first nut 23 with the possible interposition of a second gasket 24.

Advantageously, the end of the bush 18 also protrudes on the opposite side with respect to the box-like structure 21, is externally threaded and interacts with a second nut 25 with the interposition of a possible third gasket 26.

Figure 4:
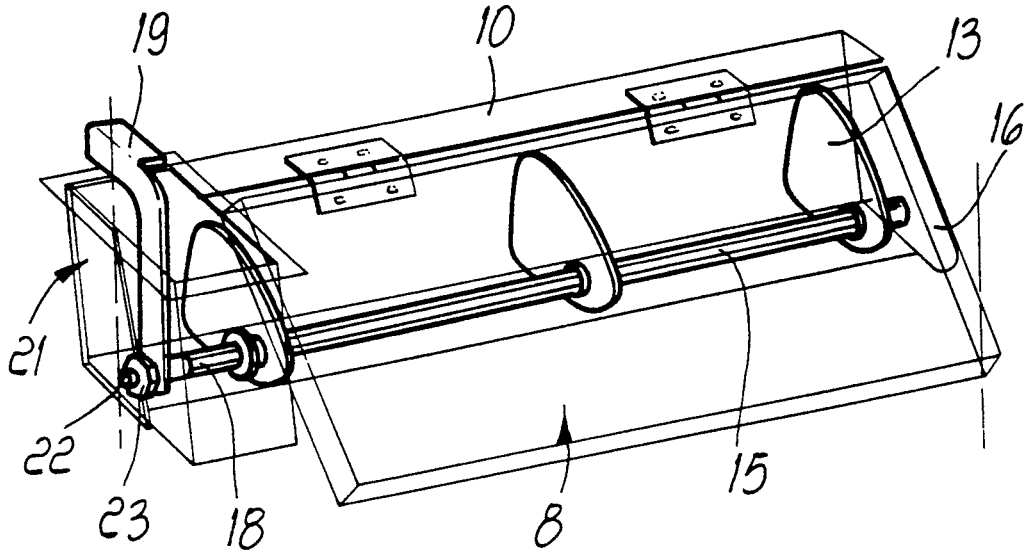
FIG. 4 is a schematic lateral perspective view of the shutter, of the cams and of the lever in the position in which the shutter is open.
Figure 5:
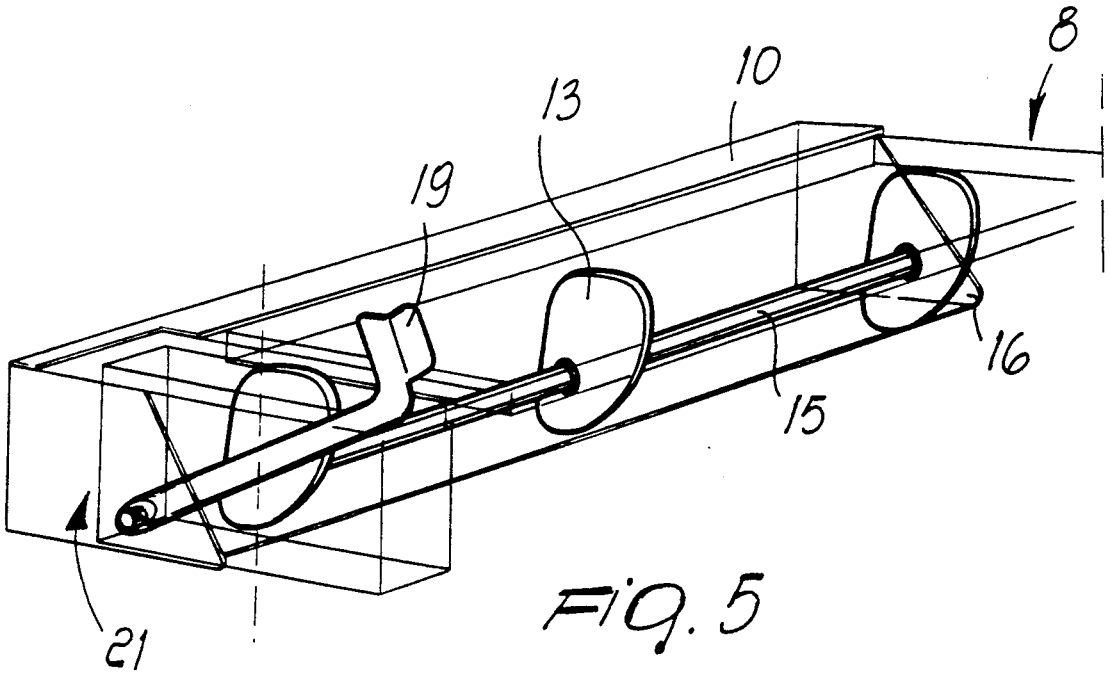
FIG. 5 is a view, similar to the preceding one, of the condition in which the shutter is closed.

The configuration of the cams 13, which are advantageously equidistant, is such, as shown by FIGS. 4 and 5, as to arrange the shutter 8 adjacent to the grille 6, providing an airtight seal by virtue of the presence of the first gasket 12.

In this condition, the cams 13 in fact push the shutter 8 adjacent to the grille 6.

The configuration of the cams is such as to allow, by moving the lever 19, the rotation of the shutter 8 toward the bottom 7 by gravity, so as to thus free the openings provided on the grille 6.

The use of the device is thus very clear: the actuation of the lever 19, which is located in an environment which is at the same pressure as the internal environment of the building, allows the user to mutually connect or not connect the outside environment and the interior environment by means of a very simple operation.

It has thus been observed that the invention has achieved the intended aim and objects, a device having been provided which allows to achieve optimum ventilation between the interior and the outside of buildings, both of the type with continuous structural faces and of any other type of face and/or casement, ensuring perfect tightness with respect to air and weather.

The device is furthermore structurally very simple and ires no maintenance, by virtue of the use of mechanical elements which can be manufactured with self-lubricating parts or with appropriately treated materials.

The device can be easily and rapidly applied at an adapted region of the building without its application substantially altering the overall aesthetic appearance thereof, since it is inserted out of sight within a seat defined on the building itself and/or on the casement.

The presence of the lever allows to achieve a gradual adjustment of the exchange of air between the interior and the outside or vice versa by means of a very simple and easy operation.

Finally, it is stressed that the simplicity of the execution of the device allows it to be installed even by personnel which is not particularly trained.

The device is naturally susceptible to numerous modifications and variations, all of which are within the scope of the same inventive concept.

Thus, for example, the number of cams or levers, as well as their arrangement or configuration, may be the most appropriate according to the specific requirements.

The materials and the dimensions which constitute the individual components of the device may naturally also be the most appropriate according to the specific requirements.

I claim:

1. Interior ventilation adjustment device, comprising;

a first seat arrangeable in a building partition and having a first opening and a second opening, said first opening communicating with a building exterior, said second opening having a perimetric edge and communicating with a building interior;

at least one perforated grille at least partially closing said second opening;

grille openings provided in said grille;

a box-like structure for communicating exclusively with a building interior;

a bottom arranged opposite to said second opening and being inclined with respect to a horizontal plane for outward drainage of any water entering said first opening;

a third seat provided in said box-like structure;

a lever accommodated in said third seat and having a lever end;

a bush protruding from said lever end and having formed therein an axial shaft seat;

a shoulder defined by said box-like structure;

a shaft having a polygonal cross section and having one shaft end and another shaft end, said one shaft end being freely pivoted to said shoulder, said other shaft end being inserted into said axial shaft seat;

a pivotable shutter element for closing said second opening, said shutter element being actuated by said lever and accommodated in said first seat, whereby to be out of sight from the building exterior, said shutter comprising a plate having a configuration substantially matching said grille and a lower surface facing said bottom, said plate having an end and being arranged in a region underlying said grille, said end being pivoted to a support, said support being rigidly connected to said perimetric edge of said second opening, said perimetric edge being arranged opposite to said first opening whereby to allow said shutter to tilt toward said bottom;

at least one gasket associated with said plate, said gasket protruding from said plate and sealingly closing said grille openings, and;

equidistantly spaced cams keyed transversely to said shaft for sealingly securing said shutter onto said grille, said cams being perpendicular with respect to said plate and contacting said lower surface of said plate.

2. Device according to claim 1, wherein said third seat is defined in said box-like structure for communicating only with a building interior.

3. Device according to claim 1, further comprising;

a threaded pivot protruding axially from said bush at an opposite side thereof with respect to said lever;

a hole defined laterally in said box-like structure, said threaded pivot passing through said hole;

a first nut rotatably connecting said threaded pivot with said box-like structure at said hole, and;

a second gasket interposable between said nut and said box-like structure.

4. Device according to claim 3, wherein said bush has a bush end, said bush end protruding outside said box-like structure and being externally threaded, said device further comprising a second nut connected to said bush end, and a third gasket interposable between said bush end and a said second nut.

5. A ventilation device comprising;

a seat provided in an outer perimetric wall of a building;

a bottom defined by said seat;

a first opening defined by said seat and communicating with an external environment, said first opening being substantially horizontally aligned with said bottom;

a second opening communicating with a building interior and facing said bottom;

support means rigidly connected to said second opening;

a perforated grill partially closing said second opening;

a shutter underlying said perforated grille and being pivotally connected to said support means;

a first gasket interposed between said shutter and said perforated grille;

a shaft pivotally mounted in said support means;

cam means keyed to said shaft and engaging said shutter;

a box-like structure located adjacent said support means and communicating only with a building interior, and;

a lever pivotally mounted in said box-like structure and being rigidly connected to said shaft, whereby movement of said lever causes rotation of said shaft and engagement of said cam means with said shutter for moving said shutter between a first position, whereat said first gasket forms a seal between said shutter and said perforated grille, and a second position, whereat said shutter is spaced from said perforated grille.

6. Ventilation device according to claim 5, wherein said bottom is inclined downwardly towards said first opening for draining rainwater from said seat, wherein said shutter comprises a plate, said plate having a shape matching said perforated grille, and wherein said gasket is connected to said plate.

7. Ventilation device according to claim 5, wherein said shaft comprises a shaft having a polygonal cross section, and wherein said cam means comprise a plurality of equidistantly spaced cams keyed to said shaft.

8. Ventilation device according to claim 5, further comprising;

a bush connected to and protruding perpendicularly from said lever, and;

a second seat defined axially within said bush and being connected to said shaft.

9. Ventilation device according to claim 8, wherein said shaft comprises a shaft having a polygonal cross section, and wherein said second seat is complementarily shaped with respect to said shaft.

10. Ventilation device according to claim 8, further comprising;

a hole formed in said box-like structure;

a threaded pivot protruding axially from said bush at an opposite side thereof with respect to said lever, and;

a nut rotatably connecting said threaded pivot to said box-like structure at said hole.

11. Ventilation device according to claim 8, further comprising;

a hole formed in said box-like structure;

a threaded pivot protruding axially from said bush at an opposite side thereof with respect to said lever;

a nut rotatably connecting said threaded pivot to said box-like structure at said hole, and;

a second gasket interposed between said nut and said box-like structure.

12. Ventilation device according to claim 8, further comprising;

an externally threaded portion axially protruding from an opposite side of said bush with respect to said threaded pivot, and;

a nut connecting said externally threaded portion to said box-like structure.

13. Ventilation device according to claim 8, further comprising;

an externally threaded portion axially protruding from an opposite side of said bush with respect to said threaded pivot;

a second nut connecting said externally threaded portion to said box-like structure, and;

a third gasken interposed between said second nut and said box-like structure.

14. A ventilation device comprising;

a seat provided in an outer perimetric wall of a building;

a bottom defined by said seat;

a first opening defined by said seat and communicating with an external environment, said first opening being substantially horizontally aligned with said bottom;

a second opening communicating with a building interior and facing said bottom;

support means rigidly connected to said second opening;

a perforated grill partially closing said second opening;

a shutter underlying said perforated grille and being pivotally connected to said support means;

a first gasket interposed between said shutter and said perforated grille;

a shaft pivotally mounted in said support means;

cam means keyed to said shaft and engaging said shutter;

a box-like structure located adjacent said support means and communicating only with a building interior;

a lever pivotally mounted in said box-like structure and being rigidly connected to said shaft, whereby movement of said lever causes rotation of said shaft and engagement of said cam means with said shutter for moving said shutter between a first position, whereat said first gasket forms a seal between said shutter and said perforated grille, and a second position, whereat said shutter is spaced from said perforated grille;

a bush connected to and protruding perpendicularly from said lever;

a second seat defined axially within said bush and being connected to said shaft;

a threaded pivot protruding axially from said bush at an opposite side thereof with respect to said lever, and;

means for rotatably connecting said threaded pivot to said box-like structure at said hole.

15. Ventilation device according to claim 14, wherein said means for rotatably connecting said threaded pivot to said box-like structure comprise;

a hole formed in said box-like structure;

a nut rotatably connecting said threaded pivot to said box-like structure at said hole.

16. Ventilation device according to claim 14, wherein said shaft comprises a shaft having a polygonal cross section, and wherein said cam means comprise a plurality of equidistantly spaced cams keyed to said shaft.

17. Ventilation device according to claim 14, wherein said shaft comprises a shaft having a polygonal cross section, and wherein said second seat is complementarily shaped with respect to said shaft.

18. Ventilation device according to claim 14, further comprising;

a hole formed in said box-like structure;

a threaded pivot protruding axially from said bush at an opposite side thereof with respect to said lever;

a nut rotatably connecting said threaded pivot to said box-like structure at said hole, and;

a second gasket interposed between said nut and said box-like structure.

19. Ventilation device according to claim 14, further comprising:

an externally threaded portion axially protruding from an opposite side of said bush with respect to said threaded pivot;

a nut connecting said externally threaded portion to said box-like structure, and;

a third gasket interposed between said second nut and said box-like structure.

* * * * *